United States Patent [19]

Ezis et al.

[11] 4,067,943

[45] Jan. 10, 1978

[54] METHOD OF MANUFACTURING A SLIP CAST ARTICLE

[75] Inventors: Andre Ezis, Grosse Ile; John M. Nicholson, Wayne, both of Mich.

[73] Assignee: Ford Motor Company, Dearborn, Mich.

[21] Appl. No.: 753,344

[22] Filed: Dec. 22, 1976

Related U.S. Application Data

[63] Continuation-in-part of Ser. No. 597,264, July 18, 1975, abandoned.

[51] Int. Cl.[2] ..... B28B 1/26

[52] U.S. Cl. ..... 264/86; 264/221; 264/232; 264/317; 264/340; 264/DIG. 44

[58] Field of Search ..... 264/340, 134, 128, 221, 264/DIG. 44, 317, 63, 299, 232

[56] References Cited

U.S. PATENT DOCUMENTS

| | | | |
|---|---|---|---|
| 3,296,006 | 1/1967 | Horton | 264/221 |
| 3,431,332 | 3/1969 | Cummings | 264/86 |
| 3,848,040 | 11/1974 | Confer et al. | 264/86 |

*Primary Examiner*—Robert F. White

*Assistant Examiner*—John A. Parrish

*Attorney, Agent, or Firm*—William E. Johnson; Keith L. Zerschling

[57] ABSTRACT

A method of forming a slip cast article is disclosed. The slip cast article is formed in a casting volume of a forming mold which has a portion thereof formed of a dissolvable organic material which has binder properties. A casting slip is cast into the casting volume. The vehicle of the casting slip is drawn off to a level which provides a consolidated casting in the casting volume containing sufficient vehicle that the casting is resistant to shrinkage. The consolidated casting and the organic mold portion are placed in a solvent for the mold portion so that it may be dissolved. The solvent for the mold portion is one which is miscible with the vehicle of the casting slip. The consolidated casting is maintained in the solvent after the organic mold portion has been dissolved so that the dissolved organic material previously forming the mold portion may penetrate into the consolidated casting. The consolidated casting is removed from the solvent and dried so that the organic material which penetrated into the casting will remain behind in the porous structure of the casting to lend strength thereto as a binder material.

3 Claims, 5 Drawing Figures

METHOD OF MANUFACTURING A SLIP CAST ARTICLE

The invention herein described was made in the course or under a contract or subcontract thereunder with the Department of Army.

This application is a continuation-in-part of our previous application Ser. No. 597,264, filed July 18, 1975 for a Method for Making an Article by Slip Casting, now abandoned.

BACKGROUND OF THE INVENTION

Slip casting is an ancient art. Generally in this art, a ceramic material suspended in a vehicle is poured into a suitable mold. The vehicle is drawn out of the casting slip and a consolidated casting is left behind in the mold. Normally, such a consolidated casting has a low green strength. Green strength is defined as the flextural strength exhibited by an object after completion of its forming process.

The prior art has taught that binders can be added to casting slips to increase the green strength of the resulting casting. Green strength is required in the casting so that the casting may be removed from the mold in which it has been formed and thereafter handled. However, by adding binders to a casting slip, very often the final green density of the completed article is much lower than that produced from slips having no binder additive. This comes about because the binder takes up space during consolidation of the cast object and, upon subsequent burn out of the binder, the elimination of the binder produces a void. A binder addition can also alter the mechanism for slip suspension thereby forming lower density articles. Such a reduction of density because of the use of a binder system is not desirable in articles in which one desires to obtain a maximum final density.

The process set forth herein has the ability of producing a high green strength casting without the use of direct binder materials in the slip and without sacrificing the highest possible green density of the casting. In the process set forth herein, at least a portion of the mold material used in forming the shape of the casting is also instrumental in increasing the green strength of the casting.

It is the principal object of this invention to provide a method by which maximum density may be obtained in a slip cast article but yet the article will have a green strength greater than the article would have if it was formed only of consolidated casting material.

SUMMARY OF THE INVENTION

This invention is directed to a method of forming a slip cast article, and more particularly, to a method of forming a slip cast article in which the completed article has a green strength sufficient to permit its subsequent handling.

In accordance with the teachings of this invention, a slip cast article is formed by the following procedure. A first mold portion for defining a molding cavity is formed from a dissolvable organic material which (a) is readily formable to the negative of a portion of the surface area of the article it is to form, (b) is nonreactive with the casting material contained in and the vehicle of the casting slip, (c) provides a smooth, pore free surface that the casting slip can be cast against, and (d) is a binder for the casting material of the slip. Other mold portions required to define the rest of the surface of the article to be slip cast are also formed. The dissolvable mold portion and the required mold portions are assembled with a slip vehicle drawing mold portion. In their assembled condition, these elements form a casting volume which defines the shape of the article to be cast. At least one surface of the casting volume is formed by the vehicle drawing mold portion.

A slip including a vehicle and a casting material is poured into the casting volume. The first mold portion and any of the other required mold portions are disassembled from the slip vehicle drawing mold portion when the vehicle of the slip has been reduced to a level which provides for a consolidated casting in the casting volume and also provides sufficient vehicle in the consolidated casting that the casting is resistant to shrinkage. Any of the other required mold members that are disassembable are disassembled from the consolidated casting. The consolidated casting is then submerged in a solvent for the first mold portion. The solvent utilized is one which is miscible with the vehicle of the casting slip. The consolidated casting is maintained in the solvent after the first mold portion has been dissolved therefrom so that the organic material forming the first mold portion has an opportunity to penetrate into the consolidated casting. The consolidated casting is then removed from the solvent and dried. The drying action causes deposition of the organic material in the pore structure of the consolidated casting. This organic material operates as a binder to hold the green casting together. This binder improves the green strength of the article and permits it to be handled for other processing steps.

DESCRIPTION OF THE PREFERRED EMBODIMENT

Figure 1:
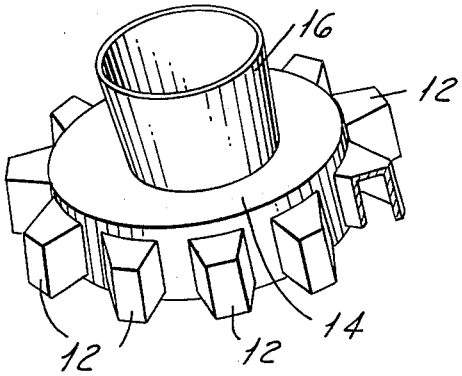
FIG. 1 is a perspective view of a mold member which defines the shape of the article to be formed.

In FIG. 1 there is seen a mold, generally designated by the numeral 10, for forming a slip cast article. The mold is made from a dissolvable organic material which is readily formable to the negative of the shape of the article to be cast. The organic material also should be a material which is nonreactive with the vehicle carrying the material to be cast therein. The organic material forming the mold also should provide a smooth, pore free surface that the article can be formed against. Also, the organic material should be one which can act as a binder for holding particles of the casting material together. The reason for this latter requirement will become apparent in a later portion of this specification.

The mold 10 is hollow on the inside. The mold has a plurality of tooth forming elements 12 attached to a hub forming element 14. The mold also has a riser portion 16, the purpose of which will be disclosed hereinbelow. Also, the mold is open across its bottom.

This mold 10 may be made from an organic material such as a wax. This wax is formed into the shape of the mold 10 by a process such as the following. A mandrel representing the shape of the gear to be cast is formed from a wax such as a water soluble wax which is dissolvable in a dilute acid solution. The wax to form the mold 10, in this case a dip seal wax (manufactured by the Freeman Manufacturing Company under the name Dip Seal-Red), is liquified and maintained at a temperature of about 165° F. The water soluable wax pattern is dipped into the liquified dip seal wax several times to form a coating of suitable thickness. This process forms the organic material mold 10 having the complex shape of a ring gear. When the dip seal wax on the mandrel is solidified, the mandrel is removed by dissolving in a water-hydrochloric acid solution leaving behind only the mold 10 which now can be used to form an article in a slip casting operation.

In the preferred embodiment, the mold 10 is a one-piece unit. However, it is within the scope of this invention to use a mold which has the dissolvable mold portion formed of organic material as only a portion of the total mold. For example, two or more mold sections may be used in conjunction with each other in the shaping of the article. These mold portions could all be made of the dissolvable material if desired. On the other hand, others of the mold portions required to define the shape of the article to be slip cast may be made from other materials such as ordinary plaster used in slip casting operations. For example, if the part to be fabricated was a ring gear with the teeth on the interior thereof, the complex shape to define the interior teeth could be made from either a dissolvable organic material or from pottery plaster as dictated by the shape of the article. If the sectional mold is made from a dissolvable material, the mold would be treated exactly like the treatment of the mold 10 as will be more fully discussed hereinbelow. If the sectional mold members are made of pottery plaster, they may be carried along with the mold 10 or they may be removed from association with the mold 10 after a slip casting operation. The remaining discussion in this specification will center about a single mold 10 but the invention herein described covers the utilization of more than one mold member and having the plurality of mold members which may be made either from the dissolvable organic material or from plaster or other suitable mold defining materials.

Figure 2:
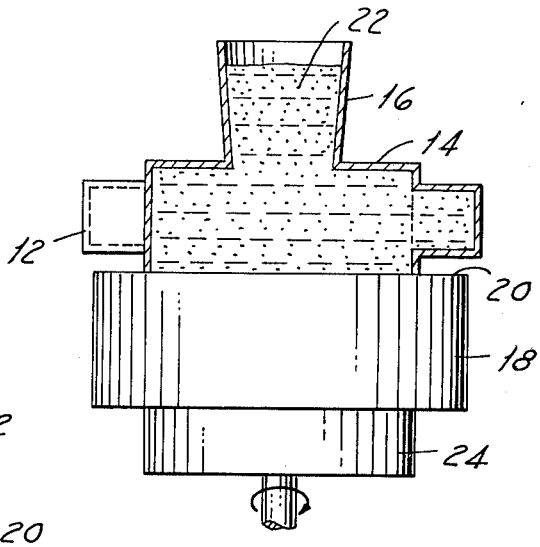
FIG. 2 is a schematical representation of the casting of an article at the beginning of the casting operation.

As best seen in FIG. 2, the mold 10 is placed on a slip vehicle drawing mold portion 18. This mold portion may be made from ordinary pottery plaster as is well known in the art. An upper surface 20 of the vehicle drawing mold portion defines a surface of a casting volume 22. As is well known in the art, the slip vehicle drawing mold portion 18 draws a vehicle of a slip out of the casting volume 22 so that the casting operation may take place.

The slip vehicle drawing mold portion 18 rests on a rotatable table 24. This table is rotated during the casting operation so as to develop forces which aid in moving particles of casting material out into the tooth forming elements 12 of the mold 10. This type of centrifugal casting is well known to those skilled in the art.

A casting slip is prepared by suspending a casting material in a suitable vehicle therefor. The casting material may be any of the hundreds of materials known to those skilled in the art. The vehicle employed in suspending the casting material may be any vehicle which is compatible with the material to be cast. In the preferred embodiment to be described herein, the vehicle of the casting slip is water and the material suspended therein is formed from silicon particles.

As mentioned above, in accordance with the disclosure of the preferred embodiment, a casting slip containing silicon particles and water will be the casting slip for casting into the casting volume 22 defined by the mold 10 and the slip vehicle drawing mold 18. Agents such as nonionic flouro-chemical surfactants may be added to the slip to decrease its surface tension thereby insuring complete wetability of the slip with the organic mold portion 10. Full details of such a casting slip are described in U.S. patent application Ser. No. 415,898 entitled "Process for Making a Silicon Nitride Article", filed on November 14, 1973 and assigned to the same assignee as this application, now abandoned. That application is hereby incorporated into this application by reference.

As best illustrated in FIG. 2, the casting slip is poured into the casting volume 22 and fills the casting volume to the top of the riser portion 16 of the mold 10. At the inception of the casting operation, the material of the slip is finely dispersed in the vehicle. This is represented in the finely dotted portion of FIG. 2. The rotatable table 24 is actuated and the mold and slip vehicle drawing mold portion 18 are rotated. As the rotation proceeds, the slip vehicle drawing mold portion 18 draws the vehicle, that is the water, out of the casting volume 22. This withdrawal of water takes place slowly over a period of time as is well known in the art.

Figure 3:
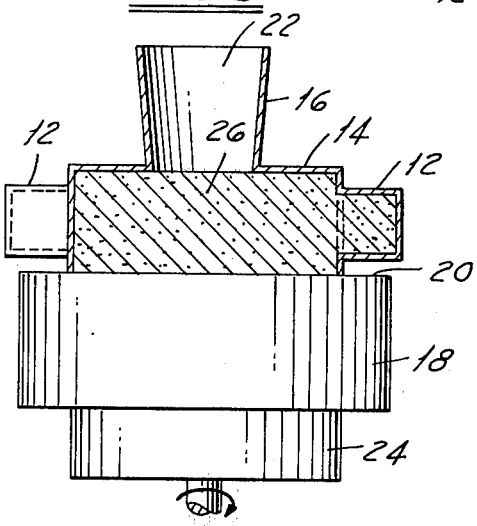
FIG. 3 is a schematic representation of the casting of an article near the end of the casting operation.

Reference is now made to FIG. 3. In this figure, the completion of the casting operation is illustrated. As the rotation of the rotatable table 24 has gone on, the vehicle of the slip has been withdrawn from the casting volume 22 leaving behind a consolidated casting 26. A small amount of slip material is still found on top of the consolidated casting. The slip vehicle drawing mold portion 18 is permitted to withdraw the vehicle of the slip until the slip in the casting volume has been reduced to a level which provides for a consolidated casting 26 in the casting volume and also provides sufficient vehicle in the consolidated casting that the consolidated casting is resistant to shrinkage. As is readily apparent, since the consolidated casting is formed from minute particles which are fitted against one another in a random fashion, the consolidated casting will be porous because the fit is not perfect.

It is necessary that the casting operation be terminated prior to a time at which the slip vehicle drawing mold portion 18 withdraws the water in the pores of the slip cast article. If the casting operation is permitted to go to that point at which the mold is withdrawing pore water, i.e., the water contained in the pores of the consolidated casting, the casting will begin to shrink in the mold and will crack. Therefore, the slip casting operation is terminated at a point which provides sufficient water in the consolidated casting and that casting is then resistant to shrinkage. The water provided in the casting is not only in the form of water in the pores, but also in the form of "hull" water which is water chemically bonded to the material being cast.

As will be apparent from the above description, the slip for forming the consolidated casting did not contain any binder material therein. Thus, the completed consolidated casting 26 may be of a higher green density than it would be if it contained such binder materials. Therefore, because no binder materials are used in the casting slip, the completed cast article is denser than that which can be achieved by use of a slip containing binders therein.

It should also be mentioned that one skilled in the art may easily recognize the time at which the slip vehicle drawing mold portion 18 is starting to withdraw pore water and hull water from the consolidated casting 26. This point is recognized because one can see the disappearance of all of the slip's vehicle from the top surface of the article being formed. Thus, an easy way for one skilled in the art to know when to terminate the casting operation would be when the slip vehicle forms only a very thin layer on top of the consolidated article.

After the casting operation, the consolidated casting 26 and mold 10 are removed from the slip vehicle drawing mold portion 18. If the mold had been made of a plurality of elements and some of the mold elements were removable, they could now be removed from association with the consolidated article 26 and the dissolvable mold portion prior to the next step in the operation. On the other hand, one may leave such elements in association with the mentioned elements if they desire to do so.

The mold 10 and consolidated casting 26 contained therein are now deposited in a tank 28 which contains a solvent 30. The solvent must be one which is a solvent for the organic material used to form the mold 10. The solvent must also be one which is miscible with the vehicle used in the casting slip. It is also crucial that the mold 10 and consolidated casting 26 contained therein be placed in the solvent while the consolidated casting still contains sufficient vehicle therein that it is resistant to shrinkage. In the case where the vehicle is water, the consolidated casting must contain all its required pore water and hull water in order that the casting still be resistant to shrinkage.

In accordance with the teachings of a preferred embodiment of this invention in which the mold 10 was formed from a dip seal wax, a suitable solvent 30 which is miscible with the water vehicle used in the casting slip is methylethyl ketone heated to a temperature of a 140° F. The MEK dissolves the dip seal wax and permits it to go into solution. Because the MEK is miscible with the water vehicle still contained as pore water and hull water in the consolidated casting, there is an interchange of the MEK containing the dissolved wax and the water of the casting because of concentration gradients. Thus, after the wax has been dissolved, an interchange of the wax containing solvent and the water of the consolidated casting is allowed to take place. Once the organic mold portion has been dissolved, the time of treatment can be for an extra additional 15 minutes or so. However, this time limit can vary depending upon the degree of interchange desired between the solvent containing the wax and the water. Also, as an additional matter, the wax containing solvent may be agitated in order to increase the interchange.

After this interchange action, the consolidated casting 26 is removed from the solvent 30 and allowed to dry. This drying may be accomplished simply at room temperature or may be brought about by a gentle drying action in a dryer. During the drying operation, any water remaining in the consolidated casting is eliminated along with any solvent contained therein. Elimination of the water and solvent leaves behind the wax which had been in solution. This wax would be distributed as minute particles throughout the pore structure of the consolidated casting and now provides a binder for such particles thereby increasing the green strength of the article. It should be noted here that the binder was introduced into the pore structure after the consolidated casting was completely formed and, thus, does not in any way affect the green density achievable in the casting operation. It is also important to note that this binder material was introduced because the solvent to dissolve the mold portion was one which was miscible with the liquid of the casting slip. Such miscibility permitted an interchange of the two different fluids and, thus, the introduction of the wax into the pore structure of the consolidated article.

To demonstrate the increase what is achieved in the green strength of the article, we manufactured one quarter by one quarter by 4 inch test bars using the dissolvable mold process described above and also produced similar bars using conventional slip casting techniques in which the mold for forming the bar was made from a conventional pottery plaster material. Bars that were cast using the conventional techniques exhibited strengths that were too low to be measured using standard strength measuring devices. Bars that were made using the dissolvable mold technique above described and a dissolving medium which was miscible with the vehicle used in the slip casting operation exhibited green strengths that averaged 4800 psi. Such green strengths enables the final casting to be handled with ease.

Figure 5:
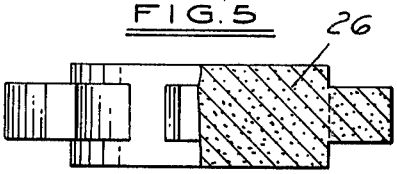
FIG. 5 is a schematical representation of the article produced by the method of this invention.
Figure 4:
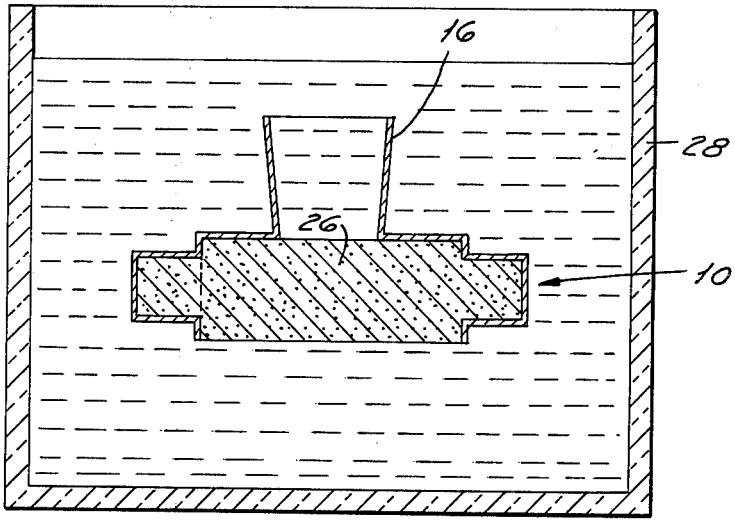
FIG. 4 is a schematical representation of the manner in which an organic mold member is removed from the cast article.

Thus, as seen in FIG. 5, the final article 26 produced will be an article in which the refractory particles, silicon particles in the preferred form, are formed into a consolidated casting. The drying operation from after the solvent treatment permits the article to shrink to its final size. Since the article is no longer encumbered by any mold portions, it may shrink free from cracks. The final article also has an excellent green strength because it contains the organic material as a binder for the particles thereof. The article may now be subjected, for example, to a heating operation which removes the binder material followed in the same furnace by an argon sintering operation which is well known in the art to sinter the individual particles together to give the article strength for further handling.

As an illustration of another manner in which the method of this invention can be carried out, a procedure is carried out as described above to produce a consolidated casting 26 contained within the mold 10. In this case, however, the elements are placed in a solvent 30 which is formulated as follows. The solvent contains 20 grams of 124° F melting point ethylene derived from hydrocarbon polymers dissolved in each 1000 milliliters of methylethyl ketone. This polymer-solvent solution is used as the solvent for removing the dip seal wax forming the mold 10.

During the interchange process, the polymer, in addition to the wax of the mold, is also drawn into the pore structure of the consolidated casting 26. Higher green strengths are achieved by this process over the use of wax alone because the polymer is a harder and more rigid material than the wax. When this additional polymer material is precipitated in the pore volume of the article, strengths up to 9,000 psi have been achieved.

It is, of course, readily apparent to one skilled in the art that the time of treatment will control the amount of polymer and wax drawn into the pore structure and the depth of penetration thereof into the article. For example, if 24 hours or more of treatment time are permitted, the concentrations of wax and polymer both within and without the consolidated casting should be substantially identical because sufficient processing time has been provided to allow the concentration driving forces to equalize the materials throughout the casting volume. If a time period of fifteen minutes to a half hour is employed, a fair interchange would have taken place and the article will have a good strength. If a time of interchange of a minute or two is allowed, then the penetration will only be a small distance from the surface and the green strength achievable obviously will be lower than that achieved for longer treatment time. Thus, one skilled in the art may tailor the strength that he desires by controlling the time of treatment of the article by the solvent containing the wax and polymer.

Another method by which one skilled in the art can control the final strength obtained is by controlling the degree of miscibility of the solvent used to dissolve the wax and the vehicle of the slip. If the two are completely miscible, it is quite obvious that the time of interchange for full penetration is less than if the two are only moderately or slightly miscible. The moderately or slightly miscible exchange would take a longer period of time for full penetration. Thus, one might control the process by controlling the degree of miscibility. In this situation by controlling the degree of miscibility, the depth to which the interchange is effective is controllable, thus providing one skilled in the art another tool in controlling the method of this invention.

Having described the method of this invention, it is apparent that those skilled in the art will be able to develop further modifications thereof which fall within the true spirit and scope thereof. It is intended that all such modifications be included within the scope of the appended claims.

What we claim is:

1. A method of forming a slip cast article which comprises the following steps:

forming a first mold portion which will form at least a portion of the surface area of the article from a dissolvable organic material which (a) is readily formable to the negative of the surface area of the article to be formed thereby, (b) is nonreactive with the material contained in and the vehicle of the casting slip, and (c) is a material which can bind together individual particles of the material contained in the casting slip;

forming other mold portions required to define other surfaces of the article to be slip cast;

assembling said first mold portion and any other required mold portions with a slip vehicle drawing mold portion so that said first mold portion, said other required mold portions and said slip vehicle drawing mold portion define a casting volume which has at least one surface formed by said slip vehicle drawing mold portion;

pouring a slip which includes a vehicle and a casting material into said casting volume;

disassembling said first mold and any of said other required mold portions from said slip vehicle drawing mold portions when said vehicle of said slip has been reduced to a level which provides for a consolidated casting of said casting material in said casting volume and also provides sufficient vehicle in said consolidated casting that said consolidated casting is resistant to shrinkage;

disassembling any of said other required mold portions which are disassembable from said consolidated casting containing said sufficient vehicle;

treating said consolidated casting containing said sufficient vehicle with a solvent for said first mold portion, said solvent being miscible with said vehicle of said casting slip;

maintaining said consolidated casting in said solvent after first mold portion has been dissolved so that said organic material forming said first mold portion can penetrate into the pore structure of said consolidated casting;

removing said consolidated casting from said solvent; and drying said consolidated casting whereby removal of said vehicle and said solvent therefrom causes deposition of said organic material of said first mold member in said pore structure of said consolidated casting thereby to increase the green strength of said consolidated casting but not reduce the green density achievable therein by consolidation of a casting slip which contains no binder materials.

2. The method of claim 1 wherein said solvent which is miscible with said vehicle of said casting slip also contained therein a dissolved hydrocarbon polymer which is also allowed to penetrate into the pore structure of the said consolidated casting as said casting is being treated with said solvent.

3. The method of claim 1 wherein said solvent is less than fully miscible with the vehicle of said casting slip.

* * * * *